US010262664B2

(12) United States Patent
Van Baelen et al.

(10) Patent No.: US 10,262,664 B2
(45) Date of Patent: Apr. 16, 2019

(54) METHOD AND APPARATUS FOR ENCODING AND DECODING DIGITAL DATA SETS WITH REDUCED AMOUNT OF DATA TO BE STORED FOR ERROR APPROXIMATION

(71) Applicant: AURO TECHNOLOGIES, Mol (BE)

(72) Inventors: Wilfried Van Baelen, Geel (BE); Bert Van Daele, Wilsele (BE)

(73) Assignee: AURO TECHNOLOGIES, Mol (BE)

( * ) Notice: Subject to any disclaimer, the term of this patent is extended or adjusted under 35 U.S.C. 154(b) by 0 days.

(21) Appl. No.: 15/550,928

(22) PCT Filed: Feb. 26, 2016

(86) PCT No.: PCT/EP2016/054157
§ 371 (c)(1),
(2) Date: Aug. 14, 2017

(87) PCT Pub. No.: WO2016/135329
PCT Pub. Date: Sep. 1, 2016

(65) Prior Publication Data

US 2018/0025736 A1 Jan. 25, 2018

(30) Foreign Application Priority Data

Feb. 27, 2015 (WO) ..... PCT/EP2015/054222

(51) Int. Cl.
*G10L 19/008* (2013.01)
*H04S 3/00* (2006.01)
*G10L 19/005* (2013.01)

(52) U.S. Cl.
CPC ..... *G10L 19/008* (2013.01); *G10L 19/005* (2013.01); *H04S 3/008* (2013.01); *H04S 2420/03* (2013.01)

(58) Field of Classification Search
CPC ..... G10L 19/008; G10L 19/005
(Continued)

(56) References Cited

U.S. PATENT DOCUMENTS

2010/0027819 A1* 2/2010 Van Den Berghe ..... G10L 19/008 381/302
2014/0023196 A1 1/2014 Xiang et al.

FOREIGN PATENT DOCUMENTS

EP 1 592 008 A2 11/2005
EP 2 092 791 A1 8/2009
(Continued)

OTHER PUBLICATIONS

International Search Report for PCT/EP2016/054157, dated Jun. 1, 2016 (PCT/ISA/210).
(Continued)

*Primary Examiner* — Shaun Roberts
(74) *Attorney, Agent, or Firm* — Sughrue Mion, PLLC

(57) ABSTRACT

When combining digital data sets in the time domain into a combined digital data set a subset of samples of each digital data set is adjusted to enable unraveling the data when decoding. To enable correction during decoding of an error introduced by the adjustment, an error approximation is stored for each adjusted sample. A set of error approximations is created which is indexed allowing substantial reduction in size of the error approximations to be stored for the adjusted samples. Instead of creating a set of error approximations for each combined digital data set one set of error approximations is created based on the errors introduced when creating multiple combined digital data sets.

18 Claims, 6 Drawing Sheets

(58) Field of Classification Search
USPC ..... 704/500
See application file for complete search history.

(56) References Cited

FOREIGN PATENT DOCUMENTS

| | | | |
|---|---|---|---|
| EP | 2 830 052 | A1 | 1/2015 |
| WO | 2008/043858 | A1 | 4/2008 |

OTHER PUBLICATIONS

Written Opinion of the International Searching Authority, dated Jun. 1, 2016 (PCT/ISA/237).

* cited by examiner

METHOD AND APPARATUS FOR ENCODING AND DECODING DIGITAL DATA SETS WITH REDUCED AMOUNT OF DATA TO BE STORED FOR ERROR APPROXIMATION

CROSS REFERENCE TO RELATED APPLICATIONS

This application is a National Stage of International Application No. PCT/EP2016/054157 filed Feb. 26, 2016, claiming priority based on International Patent Application No. PCT/EP2015/054222, filed Feb. 27, 2015, the contents of all of which are incorporated herein by reference in their entirety.

TECHNICAL FIELD

The present invention relates to encoding and decoding digital data sets, and more particular to a method for combining a first and second digital data set of samples into a third digital data set of samples.

The present invention further relates to a record carrier for storing such combined digital data set.

BACKGROUND ART

EP1592008 discloses a method for mixing two digital data sets into a third digital data set. In order to fit two digital data sets into a single digital data set with a size smaller than the sum of the sizes of the two digital data sets, a reduction of information in the two digital data sets is required. EP1592008 achieves this reduction in defining an interpolation at samples between a first set of predefined positions in the first digital data set and at a non-coinciding set of samples between predefined positions in the second digital data set. The value of the samples between the predefined positions of the digital data sets are adjusted to the interpolation value. After performing this reduction in information in the two digital data sets, each sample of the first digital data set is summed with the corresponding sample of the second digital data set. This results in a third digital data set comprising the summed samples. This summation of samples together with known relationship of the offset between the predefined positions between the first digital data set and the second digital data set allows the recovery of the first digital data set and the second digital data set, albeit only with the samples adjusted by interpolation between the predefined positions. When the method of EP1592008 is used for audio streams this interpolation is not noticeable and the third digital data set can be played as a mixed representation of the two digital data sets comprised. In order to enable the retrieval of the first and second digital data set with the adjusted samples, a start value for both the first and second digital data set must be known and hence these two values are also stored during mixing to allow a later unraveling of the two digital data sets from the third digital data set.

EP2092791 discloses an other method for mixing two digital data sets into a third digital data set. In EP2092791, instead of using interpolation, sample values are adjusted by equating them to the sample value of a neighbouring sample. A disadvantage of this method is that it introduces errors which have to be corrected during decoding.

Both methods, the interpolation in EP1592008 and the equating in EP2092791, effectively adjust the sample value of a subset of samples, thus introducing an error. In order to be able to correct this error during decoding for each adjusted sample the error must be stored for later retrieval during decoding. As storing all errors would result in large files, EP2092791 discloses a method wherein, after determining the errors, a reduction is performed by grouping the errors into error groups. For each error group a representative approximated error is chosen resulting in a sets of error approximations. These sets of error approximations are indexed. For each sample affected by the adjustment an index is chosen corresponding to that error approximation which is closest to the error or satisfies other criteria such as compensation for errors occurring when reversing the interpolation because multiple adjusted sample values are used during the reversing of the interpolation.

It is however still a disadvantage of EP 2092791 that the amount of data which needs to be stored for the sets of error approximations is still large.

It is an objective of the present invention to further reduce the amount of data to be stored for later retrieval during decoding.

DISCLOSURE OF THE INVENTION

To achieve this objective the method further comprises the steps of: grouping errors resulting from adjustment of the samples of the first, second, fourth and fifth digital data sets into error groups, storing, in the set of error approximations, one error approximation for each error group, each error approximation having an index, and associating with each error of each adjusted sample of the first, second, fourth and fifth digital data set of adjusted sample values the corresponding index of the selected error approximation.

Instead of having one set of error approximations per combined channel as disclosed in EP2092791, one set of error approximations is used for encoding and decoding more than just one combined channel. Surprisingly it was found that even in situations where the digital data channels have little correlation, it is beneficial to group errors from channels that are not to be combined into a single set of error approximations, thus being able to create a single set of error approximations and needing a smaller amount of data to store this set of error approximations than when each combined digital data set had its own sets of error approximations.

Alternatively, it is possible to use this advantage not to reduce the amount of storage space for the set of error approximations but to increase the number of errors approximations when using the same amount of storage space as was used when each combined digital data set had its own sets of error approximations. This allows more error approximations to be stored allowing a more accurate approximation of the errors, which in turn allows a more accurate reconstruction of the original digital data sets when extracting them from the combined digital data set.

In the example of the input digital data sets representing multi channel audio being combined into two combined audio channels to be played back through a stereo system, previously two sets of error approximations were created, one for each of the combined audio channels. Now, a single set of error approximations is derived that applies to both combined audio channels and is in this example derived from all input audio channels.

In an embodiment the step of grouping errors comprises the step of only grouping errors of adjusted samples of the first and second digital data sets.

Using only errors occurring during the adjustment of sample values for a single combined channel to create the set of error approximations results in a small amount of storage space needed to store this set of error approximations at the penalty of less accurate approximations for the other combined channels.

In a further embodiment the step of grouping errors comprises the step of grouping errors of adjusted samples of the first, second, fourth and fifth digital data sets. Using ail errors from all digital data channels results in the best grouping of errors and thus the best set of error approximations.

In a further embodiment the step of associating the index comprises the step of storing association data in one or more meta data blocks of one or more of the combined digital data sets.

Storing the association information in meta data blocks allows this data to be both embedded in the combined digital data sets or to be stored in or transmitted via an auxiliary channel.

A decoding method as claimed comprises the steps of retrieving a single set of error approximations, each error approximation in the single set of error approximations having an index, and retrieving an association of each adjusted sample of the first, second, fourth and fifth digital data set with a corresponding index of the error approximations retrieving for each adjusted sample an error approximation corresponding to the index associated with the sample, adding the corresponding error approximation to the sample.

Having a single set of error approximations allows the decoder to retrieve the error approximations quicker and use a single set or error approximations for decoding multiple combined digital data sets allowing a more efficient processing of the combined digital data sets.

An encoder as claimed benefits from the same advantages as obtained by the encoding method.

A decoder as claimed benefits from the same advantages as obtained by the decoding method.

A mobile device comprising an encoder and or decoder benefits from the same advantages as obtained by the encoding method and/or decoding method. In particular mobile devices are often limited in processing and storage capabilities compared to non-mobile devices and as such storage and processing efficiency are highly beneficial for a mobile device.

A multimedia device as claimed benefits from the same advantages as the encoding and/or decoding method as most multimedia data streams are digital data streams and very often many digital data streams are combined into combined digital data streams for storage or transmission purposes which the multimedia device must either be able to encode and/or decode.

A recording medium as claimed can have the meta data blocks both embedded in the combined digital data set(s) or separately stored on the disc.

An explanation of the basic principle of combining digital data sets employing interpolation can be found in paragraphs [0037] up to and including [0048] of EP1592008B1 and is incorporated by reference. An explanation of the interpolation used when combining digital data sets can be found in paragraph [0055] up to and including [0060] of EP1592008B1 and is incorporated by reference.

An explanation of the basic unmixing principle employing interpolation can be found in paragraph [0061] & [0062] of EP1592008B1 and is incorporated by reference.

An explanation of the errors introduced by the equating of neighboring samples can be found on page 4 line 39 up to and including line 54 of EP2092791B1 and is incorporated by reference. An explanation of indexing the set of error approximations can be found in paragraph [0017] of EP2092791B1 and is incorporated by reference.

The use of digital data sets in multi channel audio is disclosed in paragraph [0027] up to and including [0033] and are incorporated here by reference.

An explanation of the basic unmixing principle employing equating can be found in paragraph [0067] & [0068] of EP2092791B1 and is incorporated by reference.

A encoder as described herein can be integrated in a larger device such as a recording system or can be a stand alone encoder coupled to a recording system or a mixing system. The encoder can also be implemented as a computer program for instance for performing the encoding methods of the present invention when run on a computer system suitable to run said computer program. A decoder as described herein can be integrated in a larger device such as an output module in a playback device, an input module in an amplification device or can be a standalone decoder via its input coupled to a source of the encoded combined data stream and via its output coupled to an amplifier.

A digital signal processing device is in this document understood to be a device in the recording section of the recording/transmission/reproduction chain, such as audio mixing table, a recording device for recording on a recording medium such as optical disc or hard disk, a signal processing device or a signal capturing device.

A reproduction device is in this document understood to be a device in the reproduction section of the recording transmission/reproduction chain, such as an audio amplifier or a playback device for retrieving data from a storage medium.

BRIEF DESCRIPTION OF THE DRAWINGS

The invention will be further elucidated by means of the following description and the appended figures.

MODES FOR CARRYING OUT THE INVENTION

Figure 1:
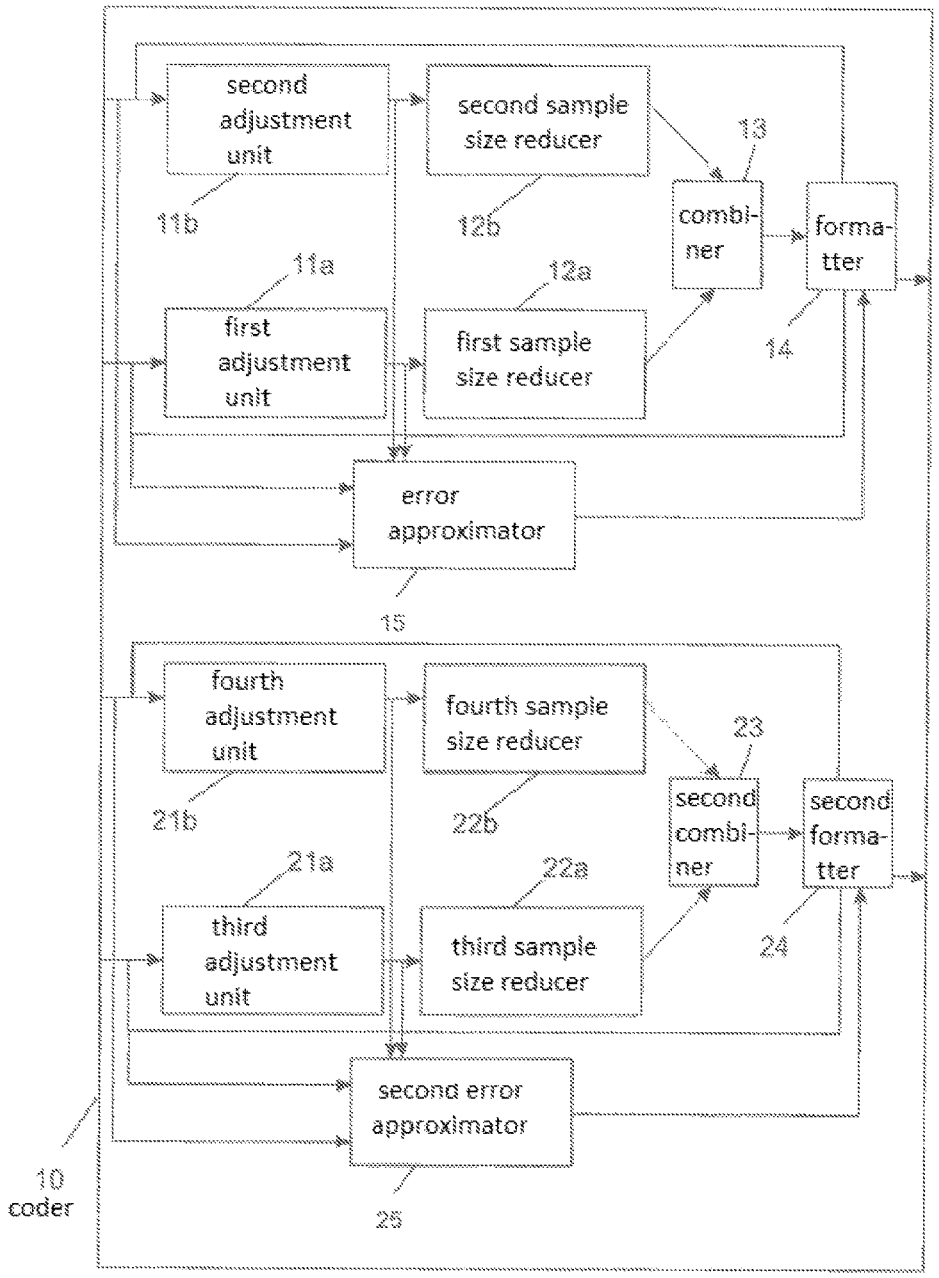
FIG. 1 shows a prior art encoder for combining four channels into two channels.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and a" should not be limited to devices consisting only of components A and B, rather with respect to the present invention, the only enumerated components of the device are A and B, and further the claim should be interpreted as including equivalents of those components.

Further, in order to explain the principle, the embodiments are explained using two input streams but the invention can equally be used with three or more input streams being combined into one single output stream. It should further be noted that although the embodiments use separate adjusters, combiners, error approximators, etc for each channel it is equally possible to have just a single adjuster, combiner, error approximator which processes all the channels/digital data sets.

Referring to FIG. 1, FIG. 1 shows a prior art encoder for combining four channels into two channels. The coder 10, in order to create a first combined digital data set, comprises a first adjustment unit 11*a* and a second adjustment unit 11*b*. Each adjustment unit 11*a* and 11*b* receives a digital data set from a respective input of the encoder 10. The first adjustment unit 11*a* selects a first subset of samples of the first digital data set and adjusts each sample of this first subset for instance by equating them to neighbouring samples of a second subset of samples of the first digital data set or by adjusting them to an interpolated value. The resulting digital data set comprising the unaffected samples of the second subset and the adjusted samples of the first sub set can be passed on to a first optional sample size reducer 12*a* or can be passed directly to the combiner 13. The second adjustment unit 11*b* selects a third subset of samples of the second digital data set and adjusts each sample of this third subset for instance by equating them to neighbouring samples of a fourth subset of samples of the second digital data set or by adjusting them to an interpolated value. The resulting digital data set comprising the samples of the fourth subset and the adjusted samples of the third sub set can be passed on to an second optional sample size reducer 12*b* or can be passed directly to the combiner 13. The first and second sample size reducer 12*a* and 12*b* both remove a defined number of lower bits from the samples of their respective digital data sets, for instance reducing 24 bit samples to 20 bits by removing the four bits least significant bits. The adjustment of samples as performed by the adjustment units 11*a* and 11*b* introduces an error. This error is approximated by an error approximator 15 by comparing the adjusted samples to the original samples and selecting an error approximation that best fits the error. This error approximation can be used by the decoder to more accurately restore the original digital data sets, as will be described below when describing the decoder. The combiner 13 adds the samples of the first digital data set to corresponding samples of the second digital data set, as provided to its inputs, and supplies the resulting samples of the third combined digital data set via its output to a formatter 14 which embeds additional data such as seed values from the two digital data sets and the association data between the errors of the adjusted samples and their corresponding error approximations as received from the error approximator 15 in the lower significant bits of the third digital data set or in meta data blocks and provides the resulting digital data set to a first output of the coder 10.

The coder 10, in order to create a second combined digital data set, further comprises a third adjustment unit 21*a* and a fourth adjustment unit 21*b*. Each adjustment unit 21*a* and 21*b* receives a digital data set from a respective input of the encoder 10. The third adjustment unit 21*a* selects a first subset of samples of the fourth digital data set and adjusts each sample of this first subset for instance by equating them to neighbouring samples of a second subset of samples of the fourth digital data set or by adjusting them to an interpolated value. The resulting digital data set comprising the unaffected samples of the second subset and the adjusted samples of the first sub set can be passed on to a third optional sample size reducer 22*a* or can be passed directly to the second combiner 23. The fourth adjustment unit 21*b* selects a third subset of samples of the fourth digital data set and adjusts each sample of this third subset for instance by equating them to neighbouring samples of a fourth subset of samples of the fourth digital data set or by adjusting them to an interpolated value. The resulting digital data set comprising the samples of the fourth subset and the adjusted samples of the third sub set can be passed on to an fourth optional sample size reducer 22*b* or can be passed directly to the second combiner 23. The third and fourth sample size reducer 22*a* and 22*b* both remove a defined number of lower bits from the samples of their respective digital data sets, for instance reducing 24 bit samples to 20 bits by removing the four hits least significant bits. The adjustment of samples as performed by the adjustment units 21*a* and 21*b* introduces an error. This error is approximated by the second error approximator 25 by comparing the adjusted samples to the original samples and selecting an error approximation that best fits the error. This error approximation can be used by the decoder to more accurately restore the original digital data sets, as will be described below when describing the decoder. The second combiner 23 adds the samples of the third digital data set to corresponding samples of the fourth digital data set, as provided to its inputs, and supplies the resulting samples of the sixth combined digital data set via its output to a second formatter 24 which embeds additional data such as seed values from the two digital data sets and the association data between the errors of the adjusted samples and their corresponding error approximations as received from the second error approximator 25 in the lower significant bits of the third digital data set or in meta data blocks and provides the resulting digital data set to a second output of the coder 10.

Figure 2:
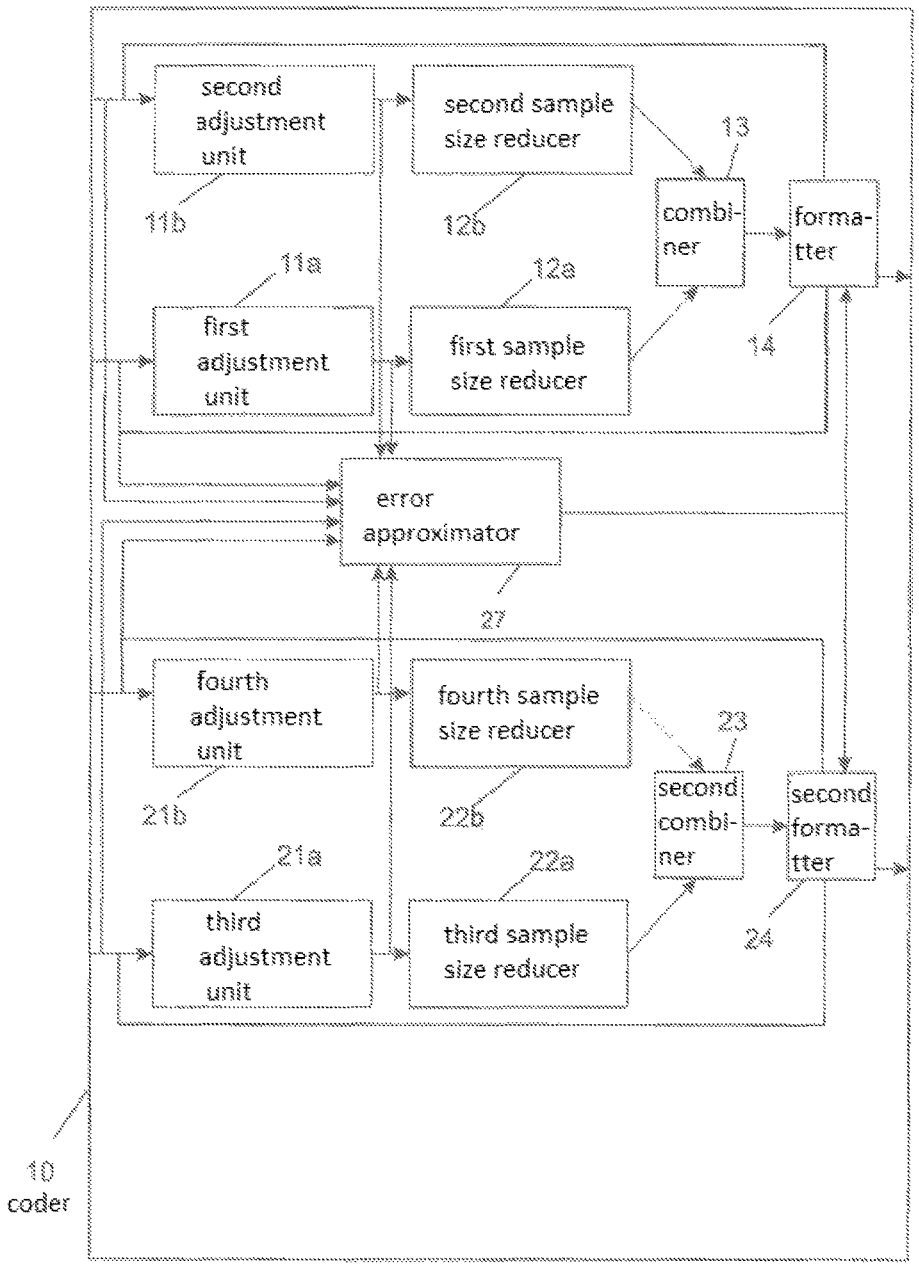
FIG. 2 shows an encoder according to the invention for combining two channels in the time domain.

Referring now to FIG. 2, FIG. 2 shows an encoder according to the present invention for combining two channels in the time domain. The coder 10, in order to create a first combined digital data set, comprises a first adjustment unit 11*a* and a second adjustment unit 11*b*. Each adjustment unit 11*a* and 11*b* receives a digital data set from a respective input of the coder 10. The first adjustment unit 11*a* selects a first subset of samples of the first digital data set and adjusts each sample of this first subset for instance by equating them to neighbouring samples of a second subset of samples of the first digital data set or by adjusting them to an interpolated value. The resulting digital data set comprising the unaffected samples of the second subset and the adjusted samples of the first sub set, can be passed on to a first optional sample size reducer 12*a* or can be passed directly to the combiner 13. The second adjustment unit 11*b* selects a third subset of samples of the second digital data set and adjusts each sample of this third subset for instance by equating them to neighbouring samples of a fourth subset of samples of the second digital data set or by adjusting them to an interpolated value. The resulting digital data set comprising the samples of the fourth subset and the adjusted samples of the third sub set can be passed on to an second optional sample size reducer 12*b* or can be passed directly to the combiner 13. The first and second sample size reducer 12*a* and 12*b* both remove a defined number of lower bits from the samples of their respective digital data sets, for instance reducing 24 bit samples to 20 bits by removing the four bits least significant bits. The combiner 13 adds the samples of the first digital data set to corresponding samples of the second digital data set, as provided to its inputs. The coder 10 in order to create a second combined digital data set comprises a third adjustment unit 21*a* and a fourth adjustment unit 21*b*. Each adjustment unit 21*a* and 21*b* receives a digital data set from a respective input of the encoder 10. The third adjustment unit 21*a* selects a first subset of samples of the fourth digital data set and adjusts each sample of this first subset for instance by equating them to neighbouring samples of a second subset of samples of the fourth digital data set or by adjusting them to an interpolated value. The resulting digital data set comprising the unaffected samples of the second subset and the adjusted samples of the first sub set can be passed on to a third optional sample size reducer 22*a* or can be passed directly to the second combiner 23. The fourth adjustment unit 21*b* selects a third subset of samples of the fourth digital data set and adjusts each sample of this third subset for instance by equating them to neighbouring samples of a fourth subset of samples of the fourth digital data set or by adjusting them to an interpolated value. The resulting digital data set comprising the samples of the fourth subset and the adjusted samples of the third sub set can be passed on to an fourth optional sample size reducer 22*b* or can be passed directly to the second combiner 23. The third and fourth sample size reducer 22*a* and 22*b* both remove a defined number of lower bits from the samples of their respective digital data sets, for instance reducing 24 bit samples to 20 bits by removing the four bits least significant bits.

The adjustment of samples as performed by the adjustment units 11*a* and 11*b* introduces an error, and the adjustment of samples as performed by the adjustment units 21*a* and 21*b* also introduces an error. These errors from the adjustment units 11*a*, 11*b*, 21*a*, 21*b* are all approximated by error approximator 27 by comparing the values of adjusted samples received from the adjustment units 11*a*, 11*b*, 21*a*, 21*b* to the values of the original samples directly taken from the corresponding inputs and selecting an error approximation from a set of error approximations that best fits the error. This error approximation can be used by the decoder to more accurately restore the original digital data sets, as will be described below when describing the decoder. As the error approximator 27 determines the approximation error for samples of several digital data sets an advantage is obtained as the approximation errors can be clustered into groups and a single set of errors that are clustered into error clusters can then be used to represent the approximation errors. This leads to efficiency on the encoder and decoder side as only one set of approximation errors need to be stored and used for multiple digital data sets, respectively multiple channels.

Instead of sending the actual error approximation value, the center value of the corresponding approximation error cluster can be sent, or an index to the cluster so that on the decoding side, where the center values of the clusters are known as a set of error approximations, the decoder can correct for the approximation error by adding the value of the center of the corresponding approximation error cluster to the reconstructed sample value.

As there is now a single error approximator 27 only a single table, i.e. a single set of error approximations is needed which can most likely be stored in one combined digital data set or, if desired, spread over multiple combined digital data sets. Multiple tables/sets of error approximations no longer need to be stored in each combined digital data sets but only a highly compressable set of error approximations or indexes, thus saving space in the data stream or in a storage medium. It should be noted that the association data linking the adjusted samples to their error approximations needs to be preserved for each adjusted samples. This association data may fit in the auxiliary channel of one combined digital data set or if needed may overflow into auxiliary data channels of other (in this case the second) combined digital data set. The association data may also be kept with the combined digital data set to which it applies.

The combiner 13 supplies the resulting samples of the third combined digital data set via its output to a formatter 14 which embeds additional data such as seed values from the two digital data sets, the set of error approximations and the association data between the errors of the adjusted samples and their corresponding error approximations as received from the error approximator 27 in the lower significant bits of the third digital data set or in meta data blocks and provides the resulting digital data set to a first output of the coder 10.

The second combiner 23 adds the samples of the third digital data set to corresponding samples of the fourth digital data set, as provided to its inputs, and supplies the resulting samples of the sixth combined digital data set via its output to a second formatter 24 which embeds additional data such as seed values from the two digital data sets in the lower significant bits of the sixth combined digital data set or in meta data blocks, and provides the resulting digital data set to a second output of the coder 10. In case the first formatter 14 was unable to fit the association data between the errors of the adjusted samples and their corresponding error approximations as received from the error approximator 27 in the third combined digital data set the remaining association data is handed to the second formatter 24 for embedding in the sixth combined digital data set.

It should be noted that the association data linking the errors of the adjusted samples to their error approximations needs to be preserved for each adjusted sample. This association data may fit in the auxiliary channel of one combined digital data set or may overflow into auxiliary data channels of other (in this case the second) combined digital data set.

In an alternative embodiment, instead of having a first and second formatter 14 and 24, a single combiner can be used that handles the task of formatting for both combined channels. This also allows the seed values, set of error approximations and association data to be combined into a single data block and this data block can be evenly distributed across the available auxiliary data channels or stored in meta data blocks. Having a single formatter facilitates this. The association data may also be kept with the combined digital data set to which it applies. The formatter controls the location where the association data is stored. Therefor, having a single formatter handling more than one combined digital data set channel enables the formatter to choose a suitable distribution of the data.

Figure 3:
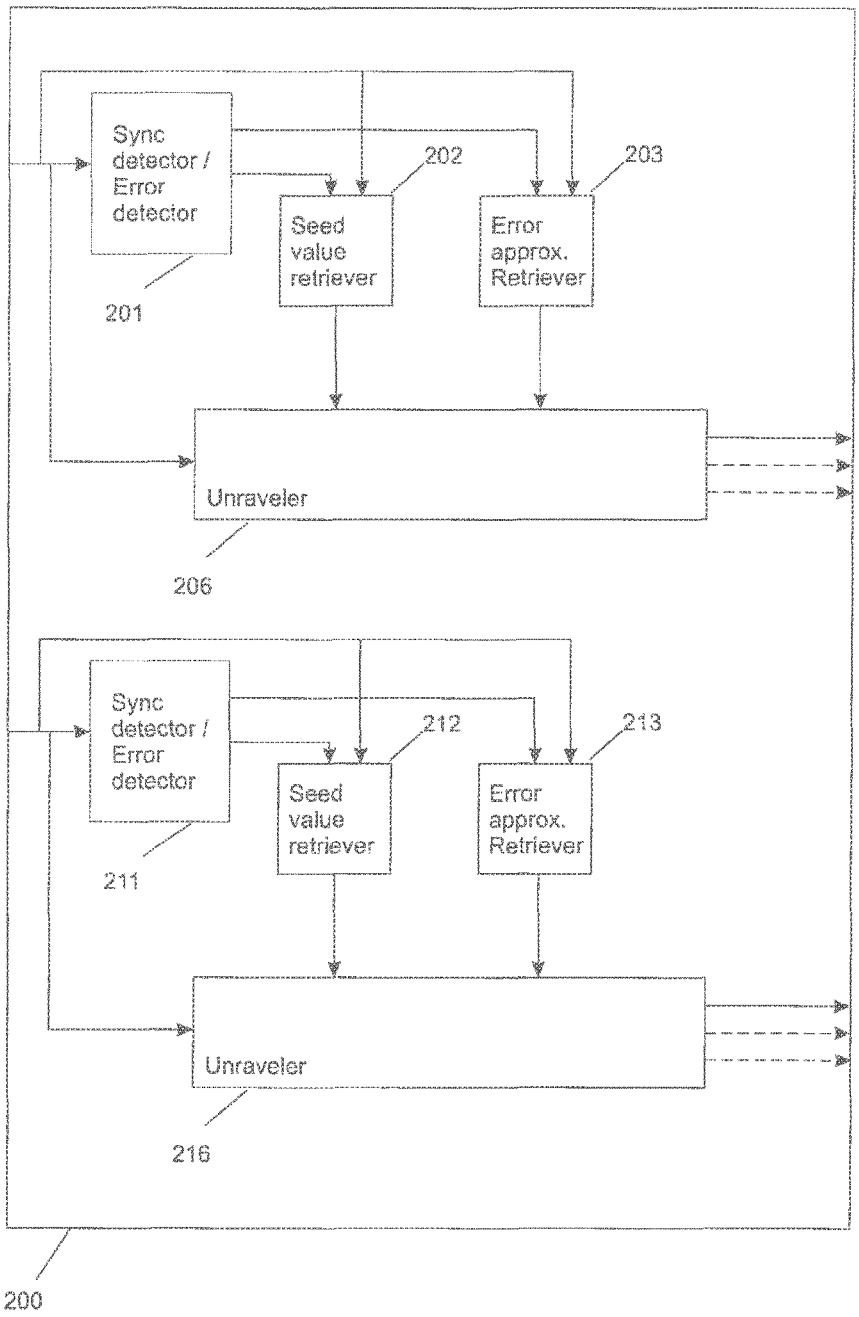
FIG. 3 shows a decoder according to the prior art.

Referring to FIG. 3, FIG. 3 shows a decoder according to the prior art. The decoder 200 for decoding a signal detects (preferably automatically) if 'audio' (e.g. 24 bit) has been encoded according to the techniques described above. This can be achieved for instance by a sync detector 201 that searches the received data stream for a synchronizing pattern in the lower significant bits. The sync detector 201 has the ability to synchronize to the data blocks in the auxiliary data area formed by the lower significant bits of the samples by finding the synchronization patterns. Alternatively the decoder 200 can retrieve the seed values and association data between errors of samples and error approximations from meta data blocks. The following will assume that the seed values and error approximation association data is embedded in the combined digital data set that is to be decoded. Once the sync detector 201 has found any of these matching patterns, it 'waits' till a similar pattern is detected. Once that pattern has been detected, the sync detector 201 gets in a SYNC-candidate-state. Based on the detected synchronizing pattern the sync detector 201 can also determine whether 2, 4, 6 or 8 bits were used per sample for the auxiliary data area.

On the $2^{nd}$ sync pattern, the decoder 200 will scan through the data block to decode the block length, and verify with the next sync pattern if there is a match between the block length and the start of the next sync pattern. If these both match, the decoder 200 gets in the Sync-state. If this test fails, the decoder 200 will restart its syncing process from the very beginning. During decode operation, the decoder 200 will always compare the block length against the number of samples between the start of each successive sync block. As soon as a discrepancy has been detected, the decoder 200 gets out of Sync-state and the syncing process has to start over.

An error correction code can be applied to data blocks in the auxiliary data area as to protect the data present. This error correction code can also be used for synchronization if the format of the Error Correction Code blocks is known and the position of the auxiliary data in the Error Correction Code blocks is known. In FIG. 3, the sync detector and error detector are shown as being combined in block 201, but alternatively the sync detector and error detector may be implemented separately as well.

The error detector calculates the CRC value (using all data from this data block, except syncs) and compares this CRC value with the value found at the end of the data block. If there is a mismatch, the decoder is said to be in CRC-Error state.

The sync detector provides information to the seed value retriever 202, the approximation error retriever 203 and the auxiliary controller 204 which allows the seed value retriever 202, the approximation error retriever 203 and the auxiliary controller 204 to extract the relevant data from the auxiliary data area as received from the first input of the decoder 200.

Once the sync detector is synced to the data block sync headers, the seed value retriever scans through the data in the data block to determine the offset, i.e. the number of samples between the end of a data block and the first duplicated audio sample (this number could theoretically be negative) and to read these duplicated (audio) samples.

The seed value retriever 202 retrieves one or more seed values from the auxiliary data area of the received digital data set and provides the retrieved seed values to the unraveler 206. The unraveler 206 performs the basic unraveling of the digital data sets using the seed value(s) as disclosed in paragraph [0067] & [0068] of EP209279161 and is incorporated here by reference.

The result of this unraveling is either multiple digital data sets, or a single digital data set with one or more digital data sets removed from the combined digital data set. This is indicated in FIG. 3 by the three arrows connecting the unraveler 206 to outputs of the decoder 200.

The approximation error retriever 203 will decompress the association data and the error approximation table. The unraveler 206 applies the error approximations received from the approximation error retriever 203 to the corresponding samples of the unraveled digital data sets and provides the resulting unraveled digital data set to the first output of the decoder.

As long as the decoder 200 stays synced to the data-block headers, the approximation error retriever 203 will continue decompressing the reference lists and the approximation tables, and supply these data to the unraveler 206 to un-mix the mixed audio samples according to C=A"+B"+E' or C-E'=A"+B". The unraveler 206 uses the duplicated audio samples to start un-mixing into A" samples and B" samples. For a combined digital data set in which two digital data sets have been combined, the even indexed samples of $A''_{2i}$ match with these of $A'_{2i}$, and $A''_{2i+1}$ are corrected by adding error approximation $E'_{2i+1}$. Similarly, the odd indexed samples of $B''_{2i+1}$ match with these of $B'_{2i+1}$, and $B''_{2i+2}$ are corrected by adding error approximation $E'_{2i+2}$. The extracted and corrected digital data sets are sent out as independent uncorrelated audio streams.

A second channel is equally decoded using a second sync detector 211, a second seed value retriever 212, a second approximation error retriever 213 and a second unraveler 216. The decoder 200 detects preferably automatically if 'audio' (e.g. 24 bit) has been encoded according to the techniques described above. This can be achieved for instance by a sync detector 211 which searches the received data stream for a synchronizing pattern in the lower significant bits. The sync detector 211 has the ability to synchronize to the data blocks in the auxiliary data area formed by the lower significant bits of the samples by finding the synchronization patterns. Alternatively the decoder 200 can retrieve the seed values and association data between errors of the samples and error approximations from meta data blocks. The following will assume that the seed values and error approximation association data is embedded in the combined digital data set that is to be decoded. Once the sync detector 211 has found any of these matching patterns, it 'waits' till a similar pattern is detected. Once that pattern has been detected, the sync detector 211 gets in a SYNC-candidate-state. Based on the detected synchronizing pattern the sync detector 211 can also determine whether 2, 4, 6 or 8 bits were used per sample for the auxiliary data area.

On the $2^{nd}$ sync pattern, the decoder 200 will scan through the data block to decode the block length, and verify with the next sync pattern if there is a match between the block length and the start of the next sync pattern. If these both match, the decoder 200 gets in the Sync-state. If this test fails, the decoder 200 will restart its syncing process from the very beginning. During decode operation, the decoder 200 will always compare the block length against the number of samples between the start of each successive sync block. As soon as a discrepancy has been detected, the decoder 200 gets out of Sync-state and the syncing process has to start over.

An error correction code can be applied to data blocks in the auxiliary data area as to protect the data present. This error correction code can also be used for synchronization if the format of the Error Correction Code blocks is known, and the position of the auxiliary data in the Error Correction Code blocks is known. In FIG. 3, the sync detector and error detector are shown as being combined in block 211. Alternatively, the sync detector and error detector may be implemented separately as well.

The error detector calculates the CRC value (using all data from this data block, except syncs) and compares this CRC value with the value found at the end of the data block. If there is a mismatch, the decoder is said to be in CRC-Error state.

The sync detector provides information to the seed value retriever 212 and the approximation error retriever 213 which allows the seed value retriever 212 and the approximation error retriever 213 to extract the relevant data from the auxiliary data area as received from the first input of the decoder 200. Once the sync detector is synced to the data block sync headers, the seed value retriever scans through the data in the data block to determine the offset, i.e. the number of samples between the end of a data block and the first duplicated audio sample (this number could theoretically be negative) and to read these duplicated (audio) samples.

The seed value retriever 212 retrieves one or more seed values from the auxiliary data area of the received digital data set and provides the retrieved seed values to the unraveler 216. The unraveler 216 performs the basic unraveling of the digital data sets using the seed value(s) as disclosed again in paragraph [0067] & [0068] of EP2092791B1 (incorporated here by reference).

The result of this unraveling is either multiple digital data sets, or a single digital data set with one or more digital data sets removed from the combined digital data set. This is indicated in FIG. 3 by the three arrows connecting the unraveler 216 to outputs of the decoder 200.

The approximation error retriever 213 will decompress the association data and the error approximation table. The unraveler 216 applies the error approximations received from the approximation error retriever 213 to the corresponding samples of the unraveled digital data sets and provides the resulting unraveled digital data set to the first output of the decoder.

As long as the decoder 200 stays synced to the data-block headers, the approximation error retriever 213 will continue decompressing the reference lists and the approximation tables, and supply these data to the unraveler 216 to un-mix the mixed audio samples according to C=A"+B"+E' or C-E'=A"+B" The unraveler 216 uses the duplicated audio samples to start un-mixing into A' samples and B' samples. For a combined digital data set in which two digital data sets have been combined, the even indexed samples of $A''_{2i}$ match with these of $A''_{2i}$ and $A''_{2i+1}$ are corrected by adding error approximation $E'_{2i+1}$. Similarly, the odd indexed samples of $B''_{2i+1}$ match with these of $B'_{2i+1}$ and $B''_{2i+2}$ are corrected by adding error approximation $E'_{2i+2}$. The extracted and corrected digital data sets are sent out as independent uncorrelated audio streams.

Figure 4:
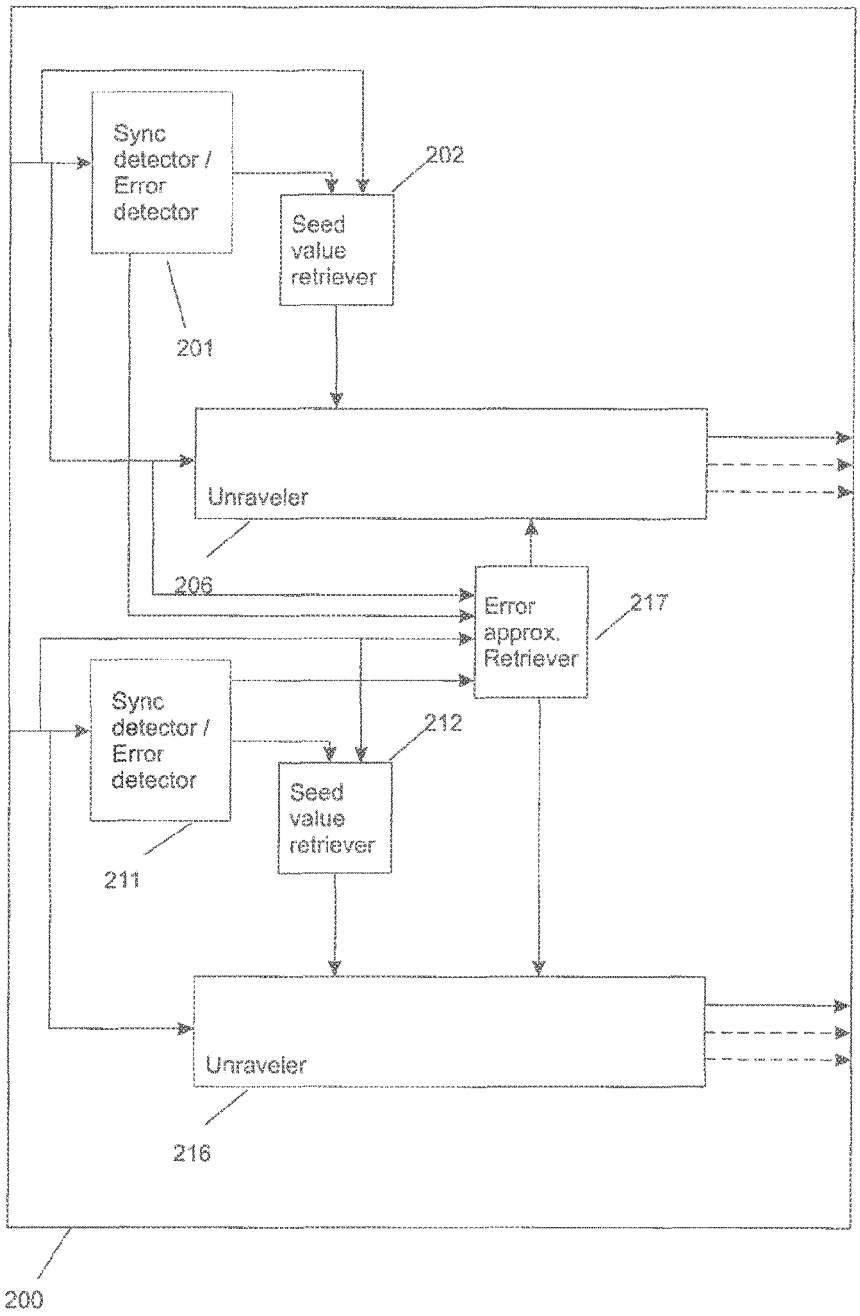
FIG. 4 shows a decoder according to the invention.

Referring now to FIG. 4, FIG. 4 shows a decoder according to the invention. The decoder 200 for decoding the signal as obtained by the invention has to some extend the same structure as the prior art decoder discussed in FIG. 3. The main difference is that the decoder of FIG. 4 has a single approximation error retriever (instead of two approximation error retrievers in FIG. 3 where one approximation error retriever is provided for each input). The sync detector 201 searches the received data stream for a synchronizing pattern in the lower significant bits. The sync detector 201 has the ability to synchronize to the data blocks in the auxiliary data area formed by the lower significant bits of the samples by finding the synchronization patterns. Alternatively the decoder 200 can retrieve the seed values and association data between errors of the samples and error approximations from meta data blocks. The following will assume that the seed values and error approximation association data is embedded in the combined digital data set which is to be decoded. Once the sync detector 201 has found any of these matching patterns, it 'waits' till a similar pattern is detected. Once that pattern has been detected, the sync detector 201 gets in a SYNC-candidate-state. Based on the detected synchronizing pattern the sync detector 201 can also determine whether 2, 4, 6 or 8 bits were used per sample for the auxiliary data area.

On the $2^{nd}$ sync pattern, the decoder 200 will scan through the data block to decode the block length, and verify with the next sync pattern if there is a match between the block length and the start of the next sync pattern. If these both match, the decoder 200 gets in the Sync-state. If this test fails, the decoder 200 will restart its syncing process from the very beginning. During decode operation, the decoder 200 will always compare the block length against the number of samples between the start of each successive sync block. As soon as a discrepancy has been detected, the decoder 200 gets out of Sync-state and the syncing process has to start over.

An error correction code can be applied to data blocks in the auxiliary data area as to protect the data present. This error correction code can also be used for synchronization if the format of the Error Correction Code blocks is known, and the position of the auxiliary data in the Error Correction Code blocks is known. In FIG. 4, the sync detector and error detector are shown as being combined in block 201, but alternatively the sync detector and error detector may be implemented separately as well.

The error detector calculates the CRC value (using all data from this data block, except syncs) and compares this CRC value with the value found at the end of the data block. If there is a mismatch, the decoder is said to be in CRC-Error state.

The sync detector provides information to the seed value retriever 202 and the approximation error retriever 217 which allows the seed value retriever 202 and the approximation error retriever 217 to extract the relevant data from the auxiliary data area as received from the first input of the decoder 200.

Once the sync detector is synced to the data block sync headers, the seed value retriever 202 scans through the data in the data block to determine the offset, i.e. the number of samples between the end of a data block and the first duplicated audio sample (this number could theoretically be negative) and to read these duplicated (audio) samples.

The seed value retriever 202 retrieves one or more seed values from the auxiliary data area of the received digital data set and provides the retrieved seed values to the unraveler first 206. The unraveler 206 performs the basic unraveling of the digital data sets using the seed value(s) as disclosed in paragraph [0067] & [0068] of EP2092791B1 which section is incorporated here by reference.

The result of this unraveling is either multiple digital data sets, or a single digital data set with one or more digital data sets removed from the combined digital data set. This is indicated in FIG. 4 by the three arrows connecting the unraveler 206 to outputs of the decoder 200.

The approximation error retriever 217 will decompress the association data and the error approximation table. The unraveler 206 applies the error approximations received from the approximation error retriever 217 on the corresponding samples of the unraveled digital data sets and provides the resulting unraveled digital data set to the first output of the decoder.

As long as the decoder 200 stays synced to the data-block headers, the approximation error retriever 217 will continue decompressing the reference lists and the approximation tables, and supply these data to the unraveler 206 to un-mix the mixed audio samples according to C=A"+B"+E' or C-E'=A"+B". The unraveler 206 uses the duplicated audio samples to start un-mixing into A" samples and B' samples. For a combined digital data set in which two digital data sets have been combined, the even indexed samples of $A''_{2i}$ match with these of $A'_{2i}$ and $A''_{2i+1}$ are corrected by adding error approximation $E'_{2i+1}$. Similarly, the odd indexed samples of $B''_{2i+1}$ match with these of $B'_{2i+1}$ and $B''_{2i+2}$ are corrected by adding error approximation $E'_{2i+2}$. The extracted and corrected digital data sets are sent out as independent uncorrelated audio streams.

A second channel is equally decoded using a second sync detector 211, a second seed value retriever 212 the same approximation error retriever 217 as used for the first channel and a second unraveler 216.

The sync detector 211 searches the received data stream for a synchronizing pattern in the lower significant bits. The sync detector 211 has the ability to synchronize to the data blocks in the auxiliary data area formed by the lower significant bits of the samples by finding the synchronization patterns. Alternatively the decoder 200 can retrieve the seed values and association data between errors of the samples and error approximations from meta data blocks. The following will assume that also for the second channel the seed values and optionally error approximation association data are embedded in the combined digital data set that is to be decoded. Once the sync detector 211 has found any of these matching patterns, it 'waits' till a similar pattern is detected. Once that pattern has been detected, the sync detector 211 gets in a SYNC-candidate-state. Based on the detected synchronizing pattern the sync detector 211 can also determine whether 2, 4, 6 or 8 bits were used per sample for the auxiliary data area.

On the $2^{nd}$ sync pattern, the decoder 200 will scan through the data block to decode the block length, and verify with the next sync pattern if there is a match between the block length and the start of the next sync pattern. If these both match, the decoder 200 gets in the Sync-state. If this test fails, the decoder 200 will restart its syncing process from the very beginning. During decode operation, the decoder 200 will always compare the block length against the number of samples between the start of each successive sync block. As soon as a discrepancy has been detected, the decoder 200 gets out of Sync-state and the syncing process has to start over.

An error correction code can be applied to data blocks in the auxiliary data area as to protect the data present. This error correction code can also be used for synchronization if the format of the Error Correction Code blocks is known, and the position of the auxiliary data in the Error Correction Code blocks is known. Hence, in FIG. 4 the sync detector and error detector are shown as being combined in block 211 for convenience, but they may be implemented separately as well.

The error detector calculates the CRC value (using all data from this data block, except syncs) and compares this CRC value with the value found at the end of the data block. If there is a mismatch, the decoder is said to be in CRC-Error state.

The sync detector provides information to the seed value retriever 212 and if association data for the error approximation is found it is provided to the approximation error retriever 213 which allows the seed value retriever 212 and the approximation error retriever 213 to extract the relevant data from the auxiliary data area as received from the first input of the decoder 200. As there is now a single approximation error retriever 217 only a single set of error approximations is needed which can most likely be stored in one combined digital data set and does not need to be stored in both combined digital data sets, thus saving space. It should be noted that the association data linking the errors of the adjusted samples to their error approximations needs to be preserved for each adjusted samples. This association data may fit in the auxiliary channel of one combined digital data set or may overflow into auxiliary data channels of other (in this case the second) combined digital data set. The association data may also be kept with the combined digital data set to which it applies.

Once the sync detector is synced to the data block sync headers, the seed value retriever scans through the data in the data block to determine the offset, i.e. the number of samples between the end of a data block and the first duplicated audio sample (this number could theoretically be negative and to read these duplicated (audio) samples.

The seed value retriever 212 retrieves one or more seed values from the auxiliary data area of the received digital data set and provides the retrieved seed values to the unraveler 216. The unraveler 216 performs the basic unraveling of the digital data sets using the seed value(s) as disclosed in paragraph [0067] & [0068] of EP2092791B1 (incorporated here by reference).

The result of this unraveling is either multiple digital data sets, or a single digital data set with one or more digital data sets removed from the combined digital data set. This is indicated in FIG. 4 by the three arrows connecting the unraveler 216 to outputs of the decoder 200.

The approximation error retriever 217 will decompress the association data and already has the error approximation table as it was retrieved in order to decode the first combined digital data set. The unraveler 216 applies the error approximations received from the approximation error retriever 217 to the corresponding samples of the unraveled digital data sets and provides the resulting unraveled digital data set to the second output of the decoder.

As long as the decoder 200 stays synced to the data-block headers, the approximation error retriever 217 will continue decompressing the reference lists and the approximation tables, and supply these data to the unraveler 216 to un-mix the mixed audio samples according to C=A"+B"+E' or C-E'=A"+B" The unraveler 216 uses the duplicated audio samples to start un-mixing into A" samples and B" samples. For a combined digital data set in which two digital data sets have been combined, the even indexed samples of $A''_{2i}$ match with these of $A'_{2i}$ and $A''_{2i+1}$ are corrected by adding error approximation $E'_{2i+1}$. Similarly, the odd indexed samples of $B''_{2i+1}$ match with these of $B'_{2i+1}$ and $B''_{2i+2}$ are corrected by adding error approximation $E_{2i+2}$. The extracted and corrected digital data sets are sent out as independent uncorrelated audio streams.

Figure 5:
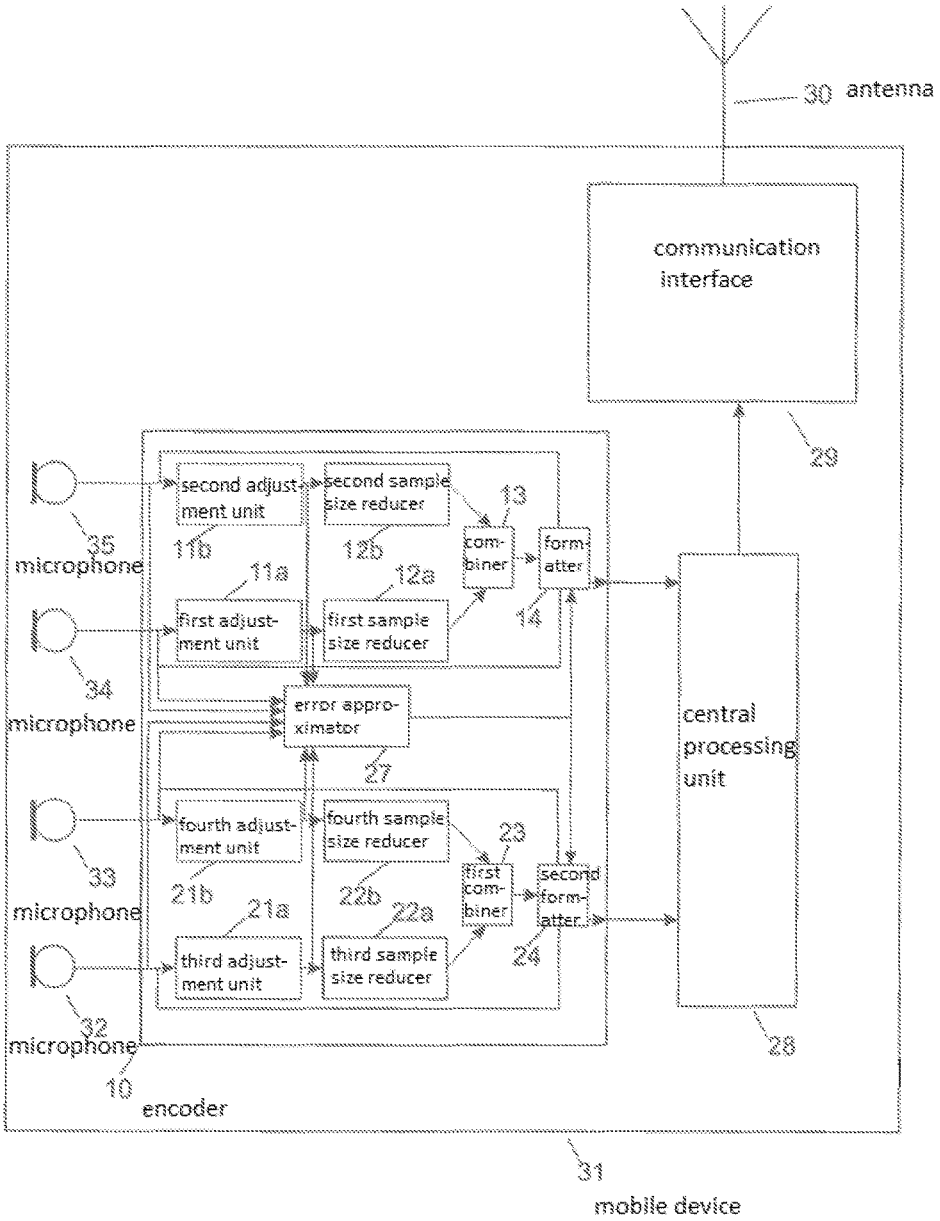
FIG. 5 shows a mobile device comprising an encoder according to the invention.

FIG. 5 shows a mobile device comprising an encoder according to the invention. The mobile device 31 comprises the encoder 10 of FIG. 4. The encoder 10 is connected to 4 microphones 32, 33, 34, 35 which provide the source of the digital data set. In order not to complicate the figure, the analog to digital conversion of the microphone signal has been omitted in FIG. 5 but the four inputs are receiving a digital data set representing the audio signal picked up by the microphones 32, 33, 34, 35. The encoder 16 combines the digital data set received from first and second microphone 35, 34 into the first combined digital data set and combines the digital data set coming from the third and fourth microphone 33, 32 into the second combined digital data set. A central processing unit 28, which coordinates the operation of the mobile device 31, receives the first and second combined digital data set from the encoder 10 and embeds the first and second combined digital data set in a transmission data set which in turn is provided to a communication interface 29 which subsequently transmits the transmission data via an antenna 30. It is evident that instead of transmitting via an antenna 30 the transmission data can also be transmitted via a wired interface. In an alternative embodiment (not shown), the first and second combined digital data sets are, instead of transmitted, stored on a storage medium such as a flash memory inside the mobile device 31 or attached to the mobile device 31.

The association data and set of error approximations can be transmitted embedded in the combined digital data sets, via meta data block transmitted via an auxiliary transmission channel or stored on the storage medium together with or embedded in the combined digital data sets.

Where FIG. 5 is described for a mobile device, the structure as shown in FIG. 5 (and the described alternatives) is the same for any other multimedia device according to the present invention. In other words, a multimedia device according to the invention has the same structure as the mobile device 31 shown in FIG. 5.

Figure 6:
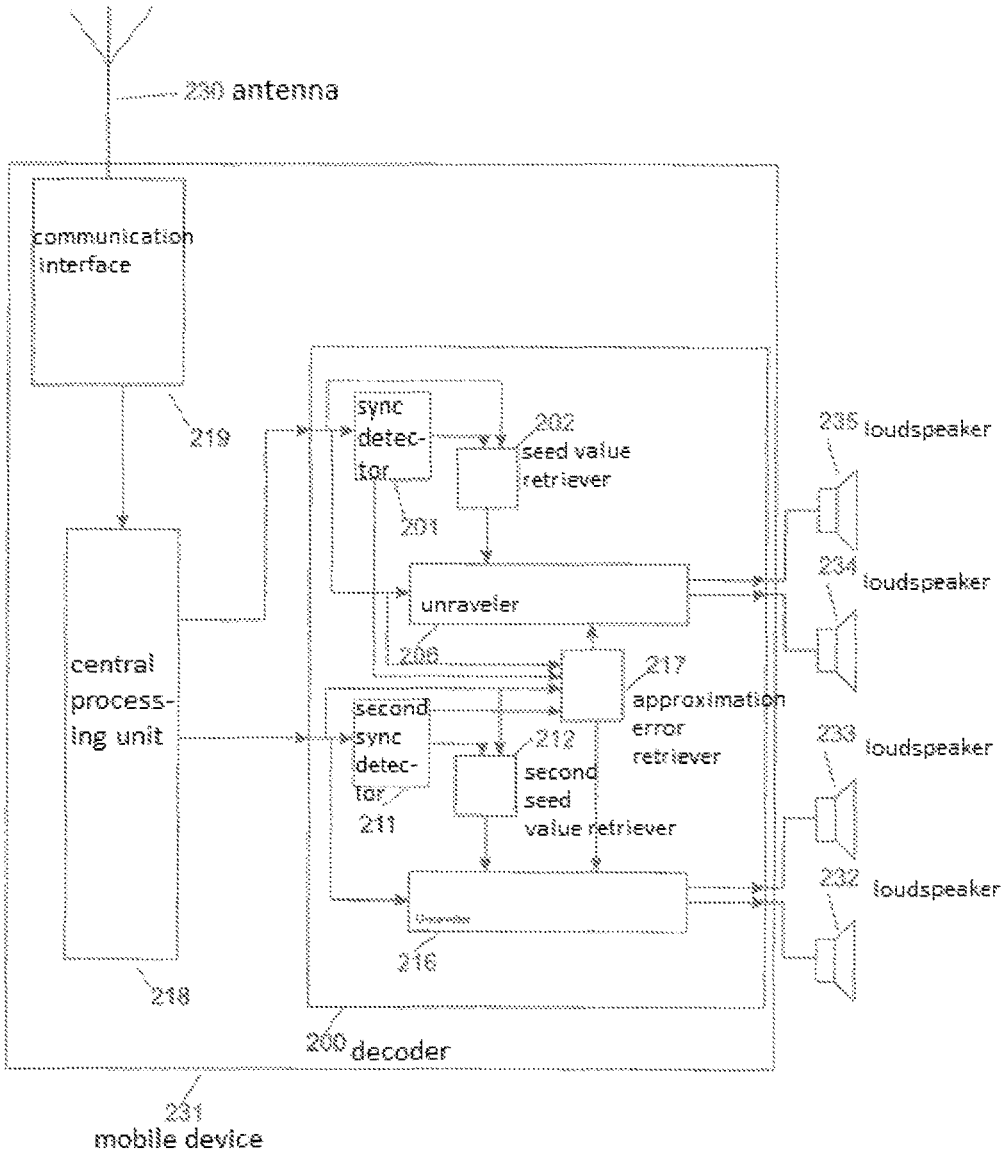
FIG. 6 shows a mobile device comprising a decoder according to the invention.

FIG. 6 shows a mobile device comprising a decoder according to the invention. The mobile device 231 comprises an antenna 230 for receiving a transmitted signal comprising transmission data comprising combined digital data sets as created using the present invention. The antenna 230 is coupled to a communication interface which receives the transmitted signal from the antenna 230 and extracts the transmission data from the transmission signal. This transmission data is provided to a central processing unit 218 which extracts from the transmission signal the first and second combined digital audio sets and in turn provides the first and second combined digital data sets to the decoder 200.

The decoder 200 which is connected to 4 loudspeaker 232, 233, 234, 235. In order not to complicate the figure, the digital to analog conversion of the extracted digital data sets into analog signals suitable for analog loudspeakers has been omitted, but the four outputs to the speakers are providing the audio signal to be reproduced by the loudspeakers 232, 233, 234, 235. Loudspeakers that accept digital data instead of analog signals of course can be fed directly without digital to analog conversion. The decoder extracts the first and second digital data sets from the first combined digital data set and extracts the third and fourth digital data sets from the second combined digital data set as described in FIG. 4.

It is evident that instead of receiving via an antenna 230 the transmission data, the transmission data can also be received via a wired interface. In an alternative embodiment (not shown), the first and second combined digital data sets are, instead of received, retrieved from a storage medium such as a flash memory inside the mobile device 31 or attached to the mobile device 31. The association data and set of error approximations can be received embedded in the combined digital data sets, via meta data block transmitted via an auxiliary transmission channel or retrieved from the storage medium.

Where FIG. 6 is described for a mobile device, the structure as shown in FIG. 6 (and the described alternatives) is the same for any other multimedia device including a decoder according to the present invention. In other words, a multimedia device suitable for receiving combined digital data sets according to the invention has the same structure as the mobile device 231 shown in FIG. 6.

The invention claimed is:

1. A method for combining a first digital data set of samples (A0, A1, A2, A3, A4, A5, A6, A7, A8, A9) with a first size and a second digital data set of samples (B0, B1, B2, B3, B4, B5, B6, B7, B8, B9) with a second size into a third combined digital data set of samples (C0, C1, C2, C3, C4, C5, C6, C7, C8, C9) with a third size smaller than a sum of the first size and the second size, by using an encoder comprising at least one processor, the method comprising:

adjusting, by the at least one processor of the encoder, each sample of a first subset of samples (A1, A3, A5, A7, A9) of the first digital data set where the first subset of samples (A1, A3, A5, A7, A9) and a second subset of samples (A0, A2, A4, A6, A8) are interleaved;

adjusting, by the at least one processor of the encoder, each sample of a third subset of samples (B0, B2, B4, B6, B8) of the second digital data set where the third subset of samples (B0, B2, B4, B6, B8) and a fourth subset of samples (B1, B3, B5, B7, B9) are interleaved, where the samples of the fourth subset (B1, B3, B5, B7, B9) and the second subset of samples (A0, A2, A4, A6, A8) have no samples corresponding in time;

generating, by the at least one processor of the encoder, the samples (C0, C1, C2, C3, C4, C5, C6, C7, C8, C9) of the third combined digital data set by adding samples (A0", A1", A2", A3", A4", A5", A6", A7", A8", A9") of the adjusted first digital data set to, in the time domain, corresponding samples (B0", B1", B2", B3", B4", B5", B6", B7", B8", B9") of the adjusted second digital data set;

embedding, by the at least one processor of the encoder, a first seed sample (A0) of the first digital data set and a second seed sample (B1) of the second digital data set in a meta data block associated to the third combined digital data set;

wherein a fourth digital data set of samples with a fourth size and a fifth digital data set of samples with a fifth size are combined into a sixth combined digital data set of samples with a sixth size smaller than a sum of the fourth size and the fifth size;

wherein each error, resulting from adjustment of the samples, is approximated by selecting an error approximation from a set of error approximations; and wherein the method further comprises:

grouping, by the at least one processor of the encoder, errors resulting from adjustment of the samples of the first, second, fourth and fifth digital data sets into error groups;

storing, by the at least one processor of the encoder, in the set of error approximations, one error approximation for each error group, each error approximation having an index; and associating, by the at least one processor of the encoder, with each error of each sample of the first, second, fourth and fifth digital data set of adjusted sample values the corresponding index of the selected error approximation, an error approximation corresponding to the index associated with each error of the adjusted sample being usable in decoding for correcting the error of the adjusted sample.

2. A method as claimed in claim 1, wherein the grouping the errors comprises only grouping errors of adjusted samples of the first and second digital data sets.

3. A method as claimed in claim 1, wherein the grouping the errors comprises grouping errors of adjusted samples of the first, second, fourth and fifth digital data sets.

4. A method as claimed in claim 1, wherein the associating the index comprises storing association data in one or more meta data blocks of one or more of the combined digital data sets.

5. A method for extracting the first digital data set of samples (A0, A1, A2, A3, A4, A5, A6, A7, A8, A9) and the second digital data set of samples (B0, B1, B2, B3, B4, B5, B6, B7, B8, B9) from the third combined digital data set of samples (C0, C1, C2, C3, C4, C5, C6, C7, C8, C9) as obtained by the method of claim 1, by using a decoder comprising at least one processor, the method comprising:

retrieving the first seed sample (A0) of the first digital data set and the second seed sample (B1) of the second digital data set from the meta data block associated to the third combined digital data set;

retrieving the first digital data set comprising the first subset of samples (A1, A3, A5, A7, A9) and the second subset of samples (A0, A2, A4, A6, A8) and the second digital data set comprising the third subset of samples (B0, B2, B4, B6, B8) and the fourth subset of samples (B1, B3, B5, B7, B9), by extracting a sample (Bn) of the second digital data set by subtracting a known value of a sample of the first digital data set from a corresponding sample of the third combined digital data set and extracting a sample of the first digital data set by subtracting a known value of a sample of the second digital data set from the corresponding sample of the third combined digital data set, where the samples of the fourth subset (B1, B3, B5, B7, B9) and the second subset of samples (A0, A2, A4, A6, A8) have no samples corresponding in time, where each sample of the first subset of samples (A1, A3, A5, A7, A9) has an adjusted value, where the first subset of samples (A1, A3, A5, A7, A9) and the second subset of samples (A0, A2, A4, A6, A8) are interleaved, where each sample of the third subset of samples (B0, B2, B4, B6, B8) has an adjusted value, where the third subset of samples (B0, B2, B4, B6, B8) and the fourth subset of samples (B1, B3, B5, B7, B9) are interleaved;

retrieving a single set of error approximations, each error approximation in the single set of error approximations having an index;

retrieving an association of each adjusted sample of the first, second, fourth and fifth digital data set with a corresponding index of the error approximations;

retrieving for each adjusted sample an error approximation corresponding to the index associated with an error of the adjusted sample; and using the corresponding error approximation to correct the error of the adjusted sample.

6. A method as claimed in claim 5, wherein the retrieving for each adjusted sample of the first, second, fourth and fifth digital data set a corresponding index comprises retrieving the association from one or more meta data blocks of one or more of the combined digital data sets.

7. The encoder configured to execute the method as claimed in claim 1, wherein the at least one processor of the encoder implements:

a first adjusting unit configured to adjust each sample of the first subset of samples (A1, A3, A5, A7, A9) of the first digital data set wherein the first subset of samples (A1, A3, A5, A7, A9) and the second subset of samples (A0, A2, A4, A6, A8) are interleaved, and to adjust each sample of the third subset of samples (B0, B2, B4, B6, B8) of the second digital data set (30) where the third subset of samples (B0, B2, B4, B6, B8) and the fourth subset of samples (B1, B3, B5, B7, B9) are interleaved, where the fourth subset of samples (B1, B3, B5, B7, B9) and the second subset of samples (A0, A2, A4, A6, A8) have no samples corresponding in time;

a combiner configured to generate the samples of the third combined digital data set by adding the samples of the first digital data set to the in the time domain corresponding samples of the second digital data set;

a formatter configured to embed a first seed sample of the first digital data set and a second seed sample of the second digital data set in the meta data block associated to the third combined digital data set;

a further adjusting unit, a further combiner, and a further formatter configured to combine the fourth digital data set of samples with the fourth size and the fifth digital data set of samples with the fifth size into the sixth combined digital data set of samples with the sixth size smaller than the sum of the fourth size and the fifth size; and an approximator configured to approximate an error, resulting from adjustment of the samples, by selecting an error approximation from the set of error approximations, wherein the at least one processor of the encoder further implements:

a grouper configured to group errors of the samples into error groups;

a storage configured to store, in the set of error approximations, one error approximation for each error group, each error approximation having an index; and an association unit configured to establish an association between the error of each sample of the first, second, fourth and fifth digital data set of adjusted sample values and a corresponding index of the selected error approximation.

8. An encoder as claimed in claim 7 where the grouper is configured to only group errors of the adjusted samples of the first and second digital data sets.

9. An encoder as claimed in claim 7 where the grouper is configured to group errors of the adjusted samples of the first, second, fourth and fifth digital data sets.

10. An encoder as claimed in claim 7, where the association unit is configured to store association data in one or more meta data blocks of one or more of the combined digital data sets.

11. A mobile device comprising the encoder as claimed in claim 7.

12. A multimedia device comprising the encoder as claimed in claim 7.

13. The decoder configured to execute the method as claimed in claim 5, wherein the at least one processor of the decoder implements:

a seed value retriever configured to retrieve the first seed sample (A0) of the first digital data set and the second seed sample (B1) of the second digital data set from the meta data block associated to the third combined digital data set, a processor configured to retrieve the first digital data set comprising the first subset of samples (A1, A3, A5, A7, A9) and the second subset of samples (A0, A2, A4, A6, A8) and the second digital data set comprising the third subset of samples (B0, B2, B4, B6, B8) and the fourth subset of samples (B1, B3, B5, B7, B9), the processor comprising an first extractor for extracting the sample (Bn) of the second digital data set and a first subtractor for subtracting the known value of the sample of the first digital data set from the corresponding sample of the third combined digital data set, the processor further comprising a second extractor for extracting a sample of the first digital data set and a second subtractor for subtracting the known value of the sample of the second digital data set from the corresponding sample of the third combined digital data set, where the samples of the fourth subset (B1, B3, B5, B7, B9) and the second subset of samples (A0, A2, A4, A6, A8) have no samples corresponding in time, where each sample of the first subset of samples (A1, A3, A5, A7, A9) has an adjusted value, where the first subset of samples (A1, A3, A5, A7, A9) and the second subset of samples (A0, A2, A4, A6, A8) are interleaved, where each sample of the third subset of samples (B0, B2, B4, B6, B8) has an adjusted value, and where the third subset of samples (B0, B2, B4, B6, B8) and the fourth subset of samples (B1, B3, B5, B7, B9) are interleaved, and retrieval unit configured to retrieve the single set of error approximations from the meta data block associated to the third combined digital data set, each error approximation in the single set of error approximations having an index, and to retrieve an association of an error of each adjusted sample of the first, second, fourth and fifth digital data set with a corresponding index of the error approximations from the meta data block and to retrieve for the error of each adjusted sample of the first subset and third subset of samples an error approximation corresponding to the index associated with the adjusted sample, using the corresponding error approximation to correct the error of each adjusted sample of the first subset and third subset of samples, and output unit configured to output the retrieved first digital data set.

14. A decoder as claimed in claim 13, where retrieval unit is configured to retrieve for each adjusted sample of the first, second, fourth and fifth digital data set an association between each adjusted sample and a corresponding index from one or more meta data blocks of one or more of the combined digital data sets.

15. A mobile device comprising the decoder as claimed in claim 13.

16. A multimedia device comprising the decoder as claimed in claim 13.

17. A non-transitory recording medium comprising a digital data set and meta data blocks as obtained by the method as claimed in claim 1.

18. A non-transitory recording medium that stores computer program, which, when executed by a computer, causes the computer to execute the method as claimed in claim 1.

* * * * *